United States Patent [19]

Schirneker

[11] 4,384,847

[45] May 24, 1983

[54] FIRE BOWL

[76] Inventor: Hans-Ludwig Schirneker, Engelslit 10, D-4773 Möhneses-Völlinghausen, Fed. Rep. of Germany

[21] Appl. No.: 172,020

[22] Filed: Jul. 24, 1980

[30] Foreign Application Priority Data

Jul. 24, 1979 [DE] Fed. Rep. of Germany ..... 2929912
Jan. 14, 1980 [EP] European Pat. Off. ..... 80100166.0

[51] Int. Cl.[3] ..... F23D 3/16

[52] U.S. Cl. ..... 431/291; 431/304; 431/311; 362/35; 362/161; 362/163

[58] Field of Search ..... 362/35, 101, 161, 162, 362/163; 431/291, 295, 289, 304, 311

[56] References Cited

U.S. PATENT DOCUMENTS 4,185,953 1/1980 Schirneker ..... 362/163

FOREIGN PATENT DOCUMENTS 119669 9/1947 Sweden ..... 362/35
251 of 1874 United Kingdom ..... 362/35

*Primary Examiner*—Carroll B. Dority, Jr.
*Attorney, Agent, or Firm*—Pearne, Gordon, Sessions, McCoy, Granger & Tilberry

[57] ABSTRACT

A fire bowl having a bowl-like container (6; 50; 72; 92) filled with a fuel like oil, and a rotary body (7; 57; 74; 95) rotatably supported above said fuel (8; 54), a plurality of non-consumable wicks being held on said rotary body, said wicks being partly immersed into said fuel and the upper ends thereof being situated within or beneath a shell (39; 52; 93) of translucent material which is open at its upper and lower ends. The rotary body can have apertures for the wicks, and for each wick (34) a separate shell (39) can be provided. The shells rest on said rotary body. In the upper side of said rotary body or in said container at least one aperture (41; 94; 96) for admitting air is provided. Preferably, said wicks being arranged in wick holders (33; 75) attached to the lower side of said rotary body.

24 Claims, 10 Drawing Figures

FIRE BOWL

Figure 1:
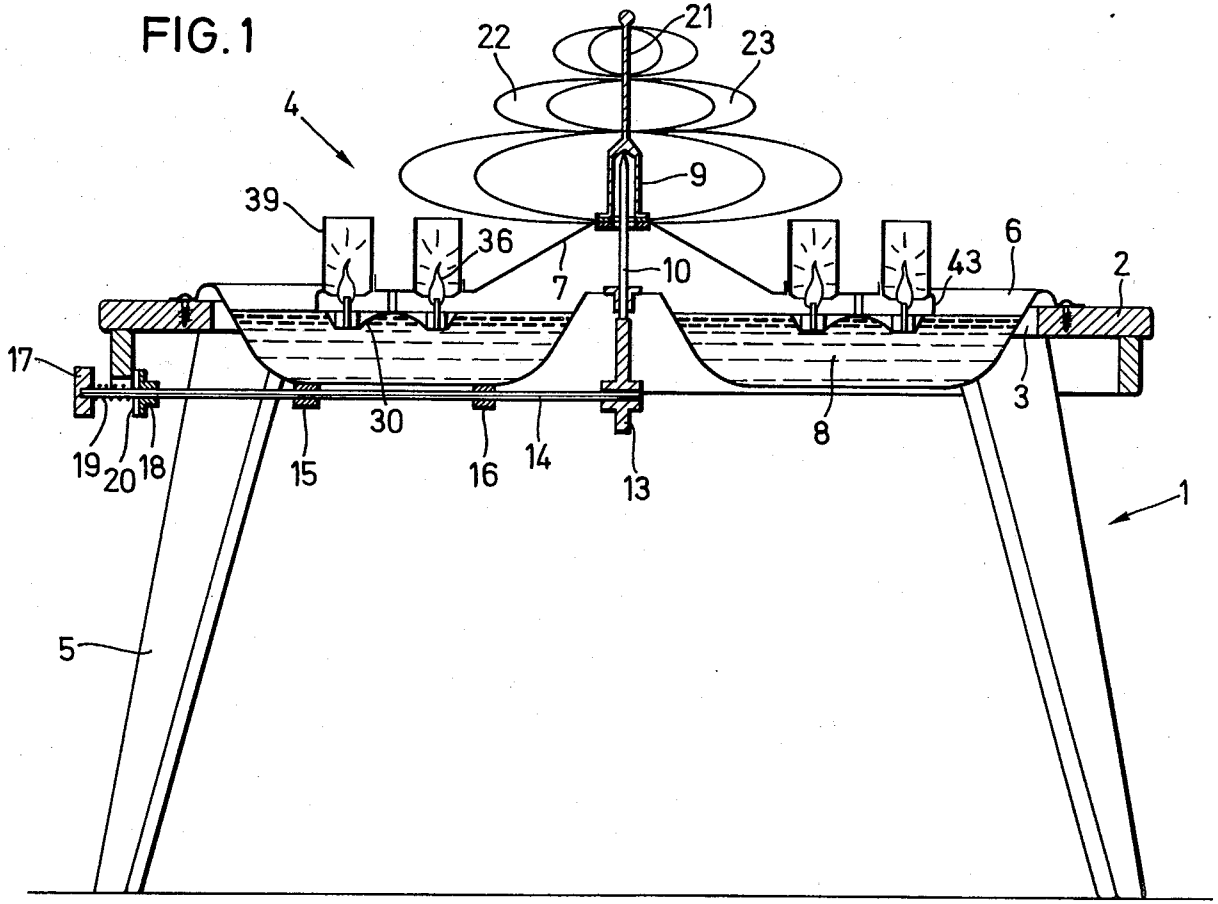

The invention relates to a fire bowl suitable for domestic use in flats, on balconies and terraces but also for restaurants, which burns with open flames and therefore cannot be only a table garnish but also contributes for heating of rooms and has a high leisure time value, for instance can be used for preparing fondue, for grilling or the like.

Candles are known which have several wicks and therefore can burn with several flames. However, the number of flames is restricted since each flame produces a certain current of air which disturbs the other flames. A further drawback of the known candles is that their length is reduced during burning so that, if as with the known candles protected by a globe, the flame should always be in a certain level, the candle must be pressed by a spring mechanism against a fixed stop face which comprises an aperture for the wick. If the candle is burned down, it must be replaced by another one which is uncomfortable and expensive.

The object of the present invention is to provide a decorative fire bowl which is suitable for room heating, for grilling or the like, and which can burn with a plurality of flames which flames are always in the same level and do not disturb one another by air current.

This object is solved by the invention thus that the fire bowl comprises a bowl-like container filled with a fuel and a rotary body rotatably supported above said fuel, wherein a plurality of wicks are held on said rotary body, which wicks immerse into said fuel while their upper end is situated within a shell of translucent material which is open at its upper and lower ends. The fuel can be a material like paraffin which is solid at room temperature or also a liquid fuel like oil. It is essential that at the upper end of the nonconsumable wick by means of the fuel a flame can burn.

Such a fire bowl has several burning positions or can burn with several flames and is in addition extremely decorative, especially since the flames can travel together with the rotary body on a circular path. The heat produced by the flames can completely be used for heating the room within which the fire bowl is situated, or can be used for other purposes, while the heat produced by wood burning with open flame in an open fire place escapes in its major part through the chimney.

Four embodiments of the fire bowl of the present invention are shown in the drawings, i.e.

Figures 2, 3:
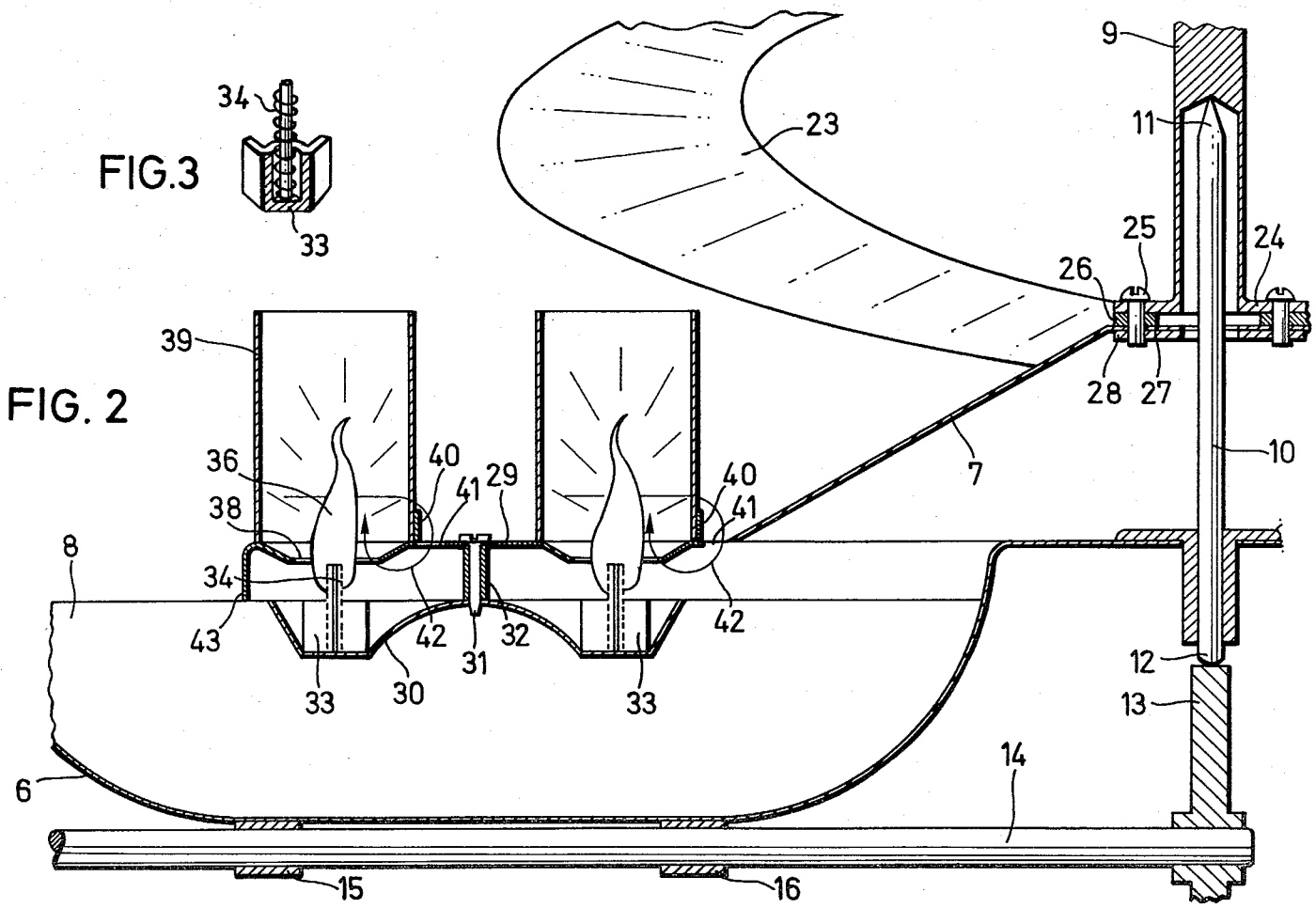
Figure 4:
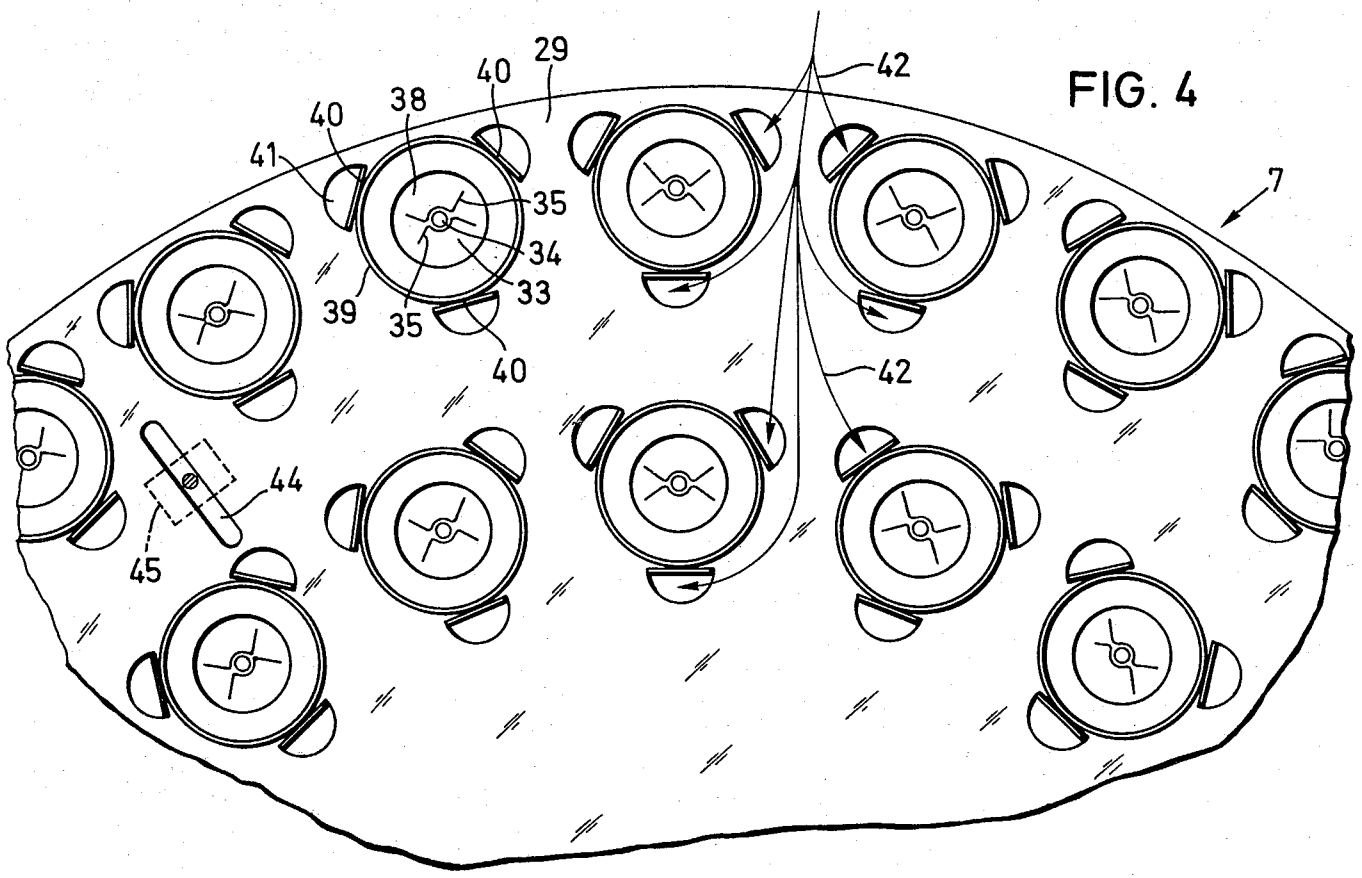
Figure 8:
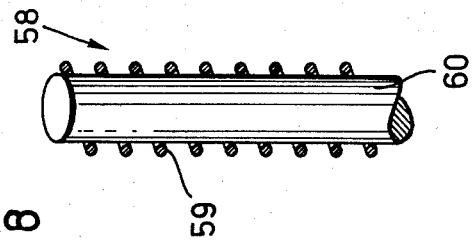
Figure 5:
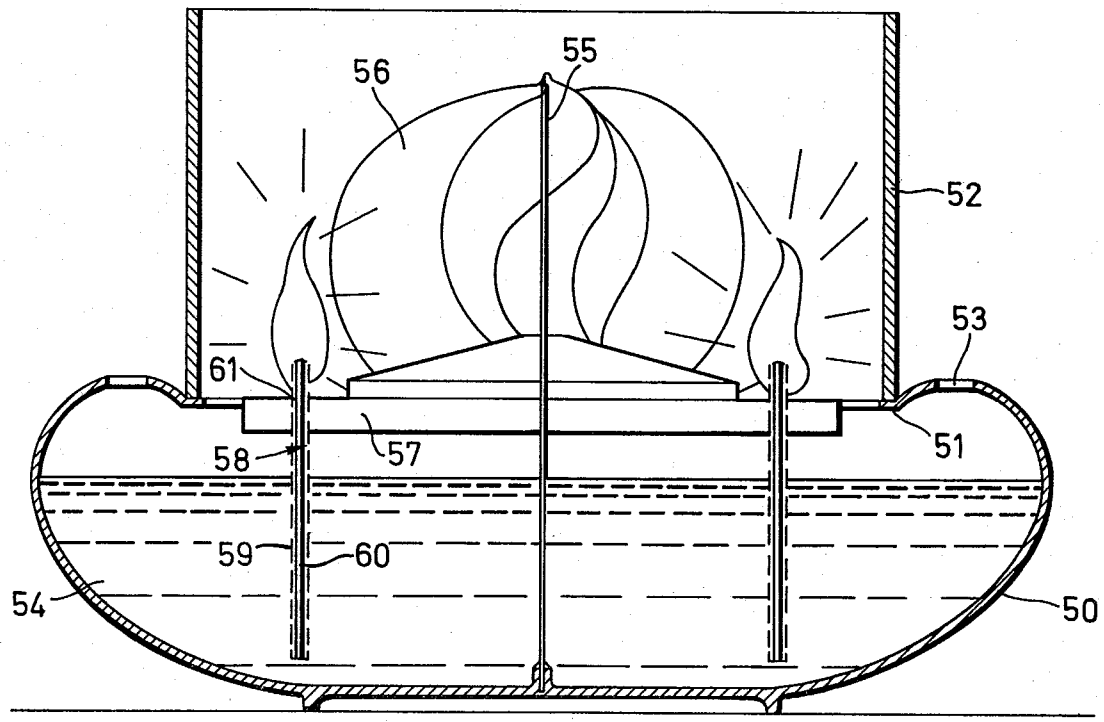
Figure 6:
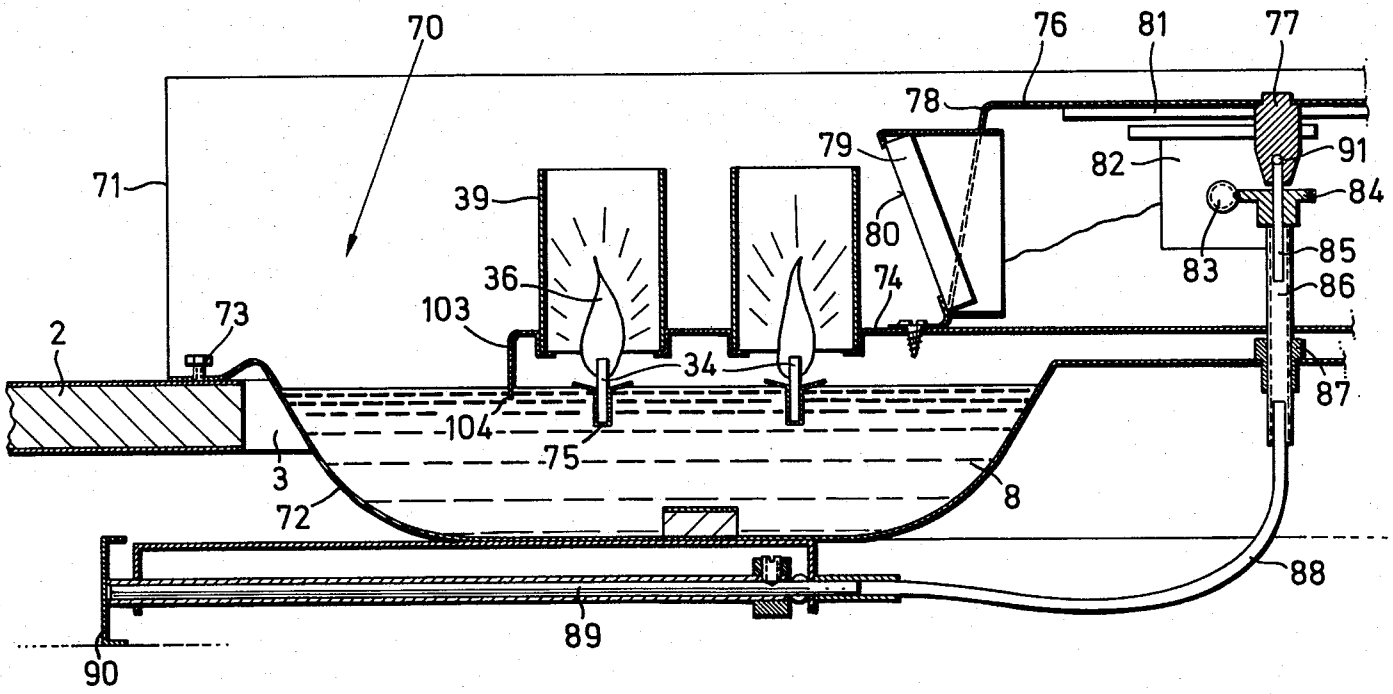
Figures 7, 9:
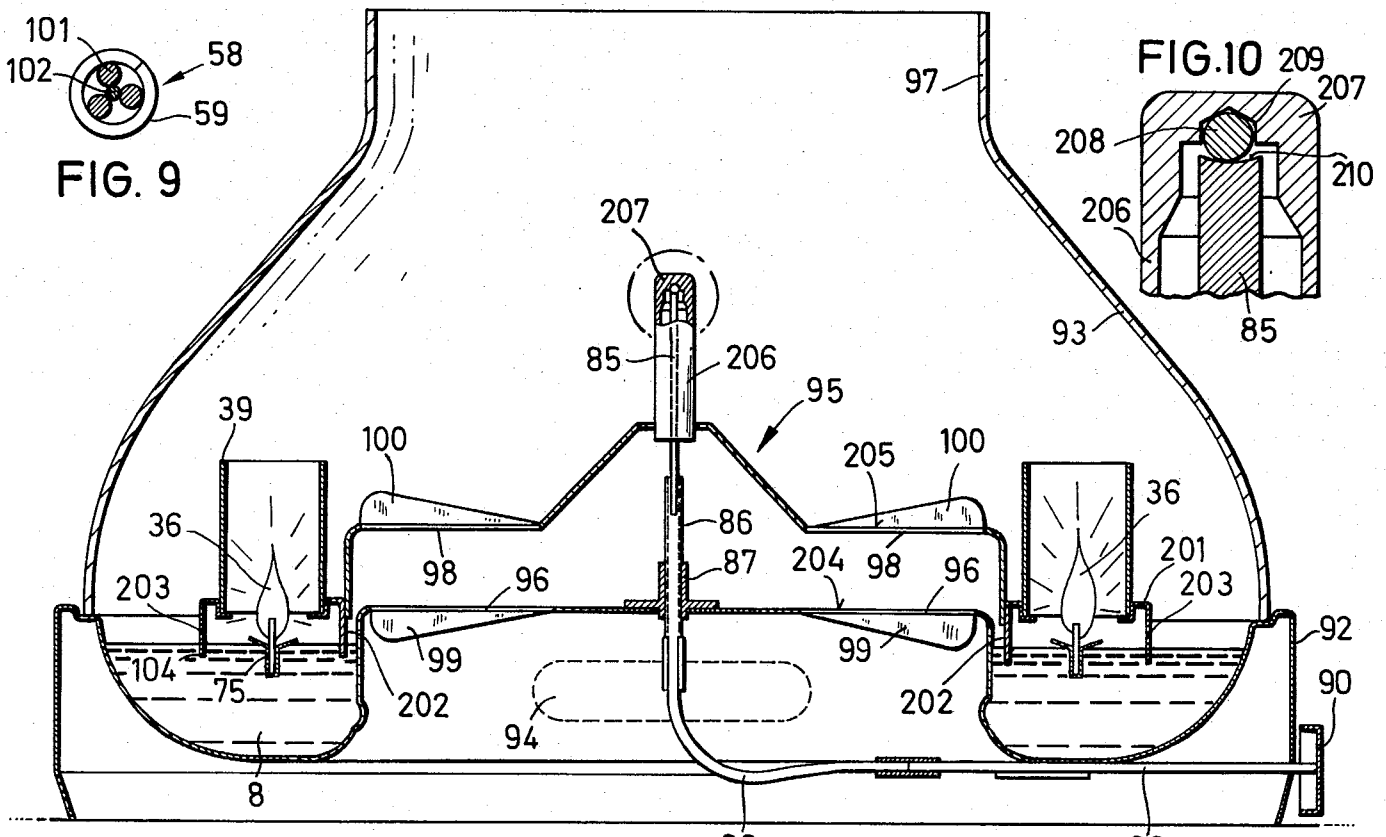

FIG. 1 is a vertical section through a first embodiment of the fire bowl which is inserted into a table, FIG. 2 is a partial section of the embodiment of FIG. 1 in approximately natural size, FIG. 3 is a perspective, partly cut view of a wick holder with a wick inserted into it, FIG. 4 is a partial view onto the rotary body shown in FIG. 2, FIG. 5 is a vertical section through a second embodiment of the fire bowl which stands on a basis, FIG. 6 is a vertical partial section of a third embodiment of the fire bowl which is inserted into a table, FIG. 7 is a vertical section of a fourth embodiment of the fire bowl, FIG. 8 is a partial view of the wick in an extremely enlarged representation, in partial section, FIG. 9 is a cross-section through a modified wick in an extremely enlarged representation, and FIG. 10 is a detail from FIG. 7.

According to FIG. 1 a table 1 has in its table-top 2 an aperture 3 into which the fire bowl 4 is inserted. At least one of the legs 5 of the table 1 is in its length adjustable so that the table-top 2 can be adjusted accurately horizontal.

The fire bowl 4 comprises a bowl-like container 6 and a rotary body 7 which is supported above the container 6 and immerses at least partially into fuel 8 filled into the container 6. In the center of the rotary body 7 a hub 9 is fastened which is arranged on a vertically movable needle 10 so that the rotary body 7 can rotate on the point 11 of the needle 10. The lower end 12 of the needle 10 rests on a cam disk 13 having preferably a spiral cam surface, which cam disk is fixed on a shaft 14 supported into bearings 15 and 16 on the underside of the bowl 6 and having at its external end knob 17 which is a handle for adjusting the cam disk 13. According to the position of the cam disk 13 the needle 10 or its point 11 extends more or less above the bowl 6 so that the position of the rotary body 7 above the bowl 6 depends on the adjustment of the cam disk 13.

Near the external end of the shaft 14 friction disk 18 is secured on it which is pressed by means of a pressure spring 19 arranged on shaft 14 against a plate 20 arranged at the underside of the table top 2 to avoid that shaft 14 and cam disk 13 can be displaced unintendedly.

On hub 9 a shank 21 is arranged as an elongation on which shank are secured sheet-metal deflectors 22 and 23 in the form of spiral sheet-metal bands for deflecting heat. Shank 21 can be telescopically extensible or can also be replaceable to enable to reduce the height of the structure above the rotary body 7 if the fire bowl is not in use.

Hub 9 has at its lower end a circumferential flange 24 to which the rotary body 7 is attached by means of screws 25. The screws 25 extend through an elastic ring 26 and a disk-like shoulder 27 of the rotary body 7 and are screwed into a disk 28. Ring 26 can be made of rubber or can be a spring washer. Therefore, screws 25 can be tightened differently to enable an exact adjustment of the rotary body 7.

At the outer rim the rotary body 7 is provided with a horizontal portion 29 below which a ring-like bowl 30 is secured by means of screws 31 and distance sleeves 32. The bowl 30 is provided for receiving wick holders 33 into each of which is inserted a wick 34. The wick holders 33 are arranged in two concentric rows and are bent from sheet metal in form of an U as shown in FIG. 3. They have radially extending lugs 35 which conduct heat from the flame 36 of the ignited wick 34 into the fuel within the bowl 30 in the vicinity of the wick holder 33.

Within the portion 29 of the rotary body 7 an aperture 38 is provided for each wick 34 so that all wicks 34 are accessable from above and the flames 36 can extend to the upper side of the rotary body 7. Each aperture 38 is situated within a cylindrical shell 39 of translucent material like glass which is arranged on the rotary body 7. In the shown embodiment, the cylindrical shells are clamped into the desired position by means of tongues 40 bent up from portion 29. The apertures 41 resulting from the tongues 40 are used for admission of air so that air is supplied to the flames 36 as indicated by arrows 42.

Alternatively, the cylindrical shells 39 can be inserted into deep drawn depressions of the portion 29. Then, special holes for supplying air are punched into the portion 29 or produced in another wise.

At the outer periphery the rotary body 7 is provided with a vertically downwards extending flange 43 on which a marking can be positioned which indicates how much the rotary body 7 must extend above the level of the fuel 8 so that the wicks 34 are free to be ignited. If the flames have been extinguished by lowering the rotary body 7 it is elevated again so that the marking on flange 43 is visible before the fuel 8 solidifies.

In FIG. 4 a slotted hole 44 is to be recognized which is provided in portion 29 of the rotary body 7. This slotted hole 44 is provided for attaching and adjusting a counter balance weight 45. Several counter weights 45 are provided on the circumference of rotary body 7 to enable to adjust the rotary body 7 accurately in horizontal position so that all wicks 34 extend evenly above the level of the fuel 8.

In the embodiment of FIG. 5 the fire bowl comprises of a container 50 which is at its top partly closed and which has an indentation 51 into which a cylindrical shell 52 of translucent material like glass is inserted. Outside of the cylindrical shell 52 the container 50 is provided with air holes 53. Within the container 50 oil 54 is provided as fuel.

On the bottom of the container 50 a shank 55 is secured, and to the point of said shank the rotary body 57 is rotatably supported via warm air deflectors 56. Near the periphery of the rotary body 57 the upper ends of wicks 58 are fixed within that rotary body, which wicks comprise of an outer wire helix 59 and a glass stick 60 inserted into the wire helix. The wicks 58 extend to the vicinity of the bottom of the container 50 and thus extend deep into the oil 54 which has been filled into the container. The upper ends of the wicks are situated in a fixed distance above the rotary body 57 so that all flames have the same size and are supplied with air from the side through air holes 53. The deflectors 56 are driving the rotary body 57.

In FIG. 8 one wick 58 is shown in much enlarged scale. The wire helix 59 which is the outer shell of the wick can be recognized as well as the glass stick 60 which is the core of the wick and which is inserted into the wire helix 59 with a tolerance of several tenth millimeters so that oil can migrate within the wick up to the flame. For this purpose grooves could be provided within the glass stick 60 extending in its axial direction.

The wicks 58 are screwed into small apertures 61 of the rotary body 57, and their height can be adjusted by turning them around the longitudinal axis since the wire helix 59 operates like the thread of a screw to be screwed into sheet metal.

In the wicks 34 and 58 heat is only slowly conducted through the outer wire helix, the pitches thereof do not touch oneanother, since a long path is necessary so that the carburation is not interrupted and thus the flame cannot extinguish. Therefore, heat is mainly conducted through the core of the wicks.

In the embodiment of FIG. 6 the fire bowl 70 inserted into the aperture 3 of a table top 2 is similar to the fire bowl shown in FIGS. 1 and 2 and can be arranged below a box-like cover 71 which is capable of being swung open. The bowl-like container 72 is supported on the table top 2 by means of adjusting screws 73 so that it can be adjusted in the desired exact position if the table top 2 is not exactly horizontal. The container 72 is in the desired correct position if on its circumference all flames 36 burn evently.

The rotary body 74 is provided like in the embodiment of FIGS. 1 and 2 with cylindrical shells 39 of translucent material and underneath arranged wicks 34 which are arranged on two concentric circular lines. However, the wicks 34 are clamped into narrow rings 75 by means of tongues bent from the side walls of said rings, the rings being made of sheet metal and are thus attached to the underside of the rotary body 74 that they are immersed into the fuel 8 within the container 72. Since only two relatively narrow rings 75 are immersed into the fuel 8, the rotary body 74 can begin to rotate already relatively soon after ignition of the wicks 34 if the fuel 8 is for instance paraffin or similar material which is at room temperature solid, because only a relatively small amount of fuel must be softened for allowing the rotary body to rotate.

In the centre of the rotary body 74 a cap 76 is provided thereon and in the centre of said cap a hub 77 is attached as bearing for the rotary body. In the outer wall 78 of said cap 76 one or more solar cells 79 are provided and the surface 80 of said cells which shall receive light is directed to the wicks 34, so that light emitted from the flames 36 is received by the solar cells 79 thus producing an electric current which is fed to an electric motor 82 arranged within the cap 76 underneath a sound absorbing plate 81. A worm 83 is arranged on the driving shaft of that electric motor 82 which meshes with a worm-gear 84 which is arranged on a shank 85 supporting the rotary body 74 like a slipping clutch with a certain friction so that normally the worm-gear 84 is stationary and the worm 83 with the electric motor 82 and thus also the rotary body 74 runs around. The electric current produced by the solar cells 79 is sufficient to provide the drive energy which rotates the rotary body 74 as soon as the heat from the flames 36 conducted through the wicks 34 downwards has molten the fuel around the rings 75. The electric motor 82 runs substantially noiseless so that for the observer it is not the simply recognizeable why the rotary body 74 rotates.

Shank 85 is fixed to the other end of a threaded spindle 86 which spindle is screwed into an internal threaded bushing 87 which bushing is attached to the centre of container 72. To the lower end of the threaded spindle 86 a flexible shaft 88 is attached, the other end of that shaft being connected with a telescopically extensible adjusting shaft 89 which is horizontally supported underneath container 72. The handle 90 of that adjusting shaft can be gripped from the outside to enable the adjustment of the height of the rotary body 74.

To enable that the rotary body 74 is easily rotatable, a ball 91 is fixed within the hub 77 and the entire rotary body 74 is supported with that ball on the upper end of shank 85. Ball 91 is arranged in a cylindrical bore of hub 77 which has only a slightly larger diameter than shank 85 so that the rotary body 74 is secured against tilting. Such security is especially of importance for flat rotary bodies of the kind shown in FIG. 6 to avoid that wax withholds down to one side the rotary body 74 when it is lifted from the container or during normal operation.

In the embodiment of FIG. 7 ring-like container 92 is similar as in the embodiment of FIG. 5 a device to be placed on a table and has a shell 93 of translucent material like glass which tapers to its upper end. In the outer wall of the container 92 several longitudinal apertures 94 are provided for air supply and which can also be used as handles. Near the centre of the container 92 comprising of sheet metal are arranged underneath the rotary body 95, which comprises also of sheet metal, several radial extending apertures 96 and above them within the rotary body 95 radially extending apertures 98 so that air can be supplied from below through the apertures 94, 96 and 98. Heated air escapes from the upper ends of the cylindrical shells 39 and rises within the shell 93. In the narrowed neck 97 of shell 93 the velocity of flow of the rising air is increased so that a suction effect is obtained and fresh air is aspirated through the apertures 94 in a larger amount as needed for combustion. The aspirated fresh air is deflected by inclined deflector sheets 99 arranged on one lateral side of each aperture 96 and impinges thereafter in the opposite direction inclined deflector sheets 100 which are arranged an one side of each aperture 98 so that the air is twice deflected. Thus, a moment of rotation is exerted onto the rotary body 95, the direction of that moment depending from the inclination direction of the deflector sheets 100. The rotary body 95 is rotated by means of this moment of rotation.

While part of the aspirated fresh air directly rises and leaves the shell 93 through the narrow neck 97 thereof, another part of the fresh air flows through apertures 41 (FIG. 4) provided in the upper side of a ring-like extension 201 of the rotary body 95 outside of the cylindrical shells 39 to the underside of the extension 201 and thus practically draft-free to the flames 36 so that the flames burn evenly and quiet without flickering. The ring-like extension 201 which is secured to the periphery of the rotary body 95 has an U-like cross-section. Both legs 202 and 203 thereof immerse into the fuel 8 so that no secondary air is supplied to the flames 36.

It can be taken from FIG. 7 that the apertures 96 and 98 are arranged in horizontal portions 204 and 205 of the container 92 and the rotary body 95, respectively.

For supporting the rotary body 95 a hollow cylindrical hup 206 is arranged in its centre, the upper end 207 thereof being closed. In that closed end 207 a ball 208 of hardened material is inserted which is pressed into a recess 209 so that it cannot be lost. The ball 208 lies in a spherical indentation 210 at the upper end of the vertical arranged shank 95 the radius of that indentation being larger than that of ball 208. Thus, the rotary body 95 is always centered with respect to shank 85. The contact area between rotary body 95 and shank 85 is limited to the punctiform contact area between ball 208 and indentation 210 so that only small frictional losses act against the moment of rotation exerted onto the rotary body 95. As can be seen from FIG. 10, the outer diameter of shank 85 is much smaller than the inside diameter of the hollow hub 206 so that no further contact between hub 6 and shank 85 is possible which could retard rotation.

The vertically outer flange 203 of the rotary body 95 which is immersing several millimeters into the fuel 8 can be provided with recesses 104 extending from the lower rim thereof which end approximately in the plane of level of fuel 8 and shall enable that hot fuel can flow along its surface and can thus circulate so that fuel (paraffin or wax) will quickly be liquified within the entire container. These recesses 104 are arranged between successive wicks 34 so that the flow has no negative influence on the wicks and the flames.

From FIG. 9 can be seen that each wick 58 comprises within the wire helix 59 at least three glass sticks 101 between which a copper wire 102 can be arranged which holds the three glass sticks 101 apart from one another so that within the wicks 58 sufficient space is provided to which the wax or other fuel can arise. The copper wire 102 provides a limited heat conduction and should not have a too large diameter.

Instead of three glass sticks 101 also more than three glass sticks can be provided within the wick. Also, it is possible to provide copper wires 102 between the several glass sticks or not. The number and size of the copper wires 102 provided for heat conduction depends on the other parts of the wicks.

What is claimed is:

1. Fire bowl, characterized in that it comprises a bowl-like container filled with a fuel like paraffin or a liquid fuel like oil, and a rotary body rotatably supported above said fuel, a plurality of non-consumable wicks held on said rotary body and being partly immersed in said fuel with the upper ends thereof being situated within or beneath a shell of translucent material which is open at its upper and lower ends, the upper end of each wick being situated within a separate shell of translucent material which is open at its upper and lower ends and which rests on said rotary body surrounding an aperture for passing one of the wicks.

2. Fire bowl as claimed in claim 1, characterized in that in the upper side of said rotary body or in said container at least one aperture for admitting air is provided, while said wicks are arranged in wick holders attached to the under side of said rotary body.

3. Fire bowl as claimed in claim 2, characterized in that the rotary body includes a disk-like portion and tongues are punched out of the disk-like portion of the rotary body and bent against the individual shells.

4. Fire bowl as claimed in claim 2, characterized in that the wicks are arranged in a ring-shaped bowl having a center area located adjacent the surface of the fuel, the bowl being secured to the rotary body at the center area and being adapted to support a wick holder.

5. Fire bowl as claimed in any one of claims 1 to 4, characterized in that support means are provided for supporting the rotary body, the support means including adjustment means for varying the height of the rotary body relative to the bowl-like container.

6. Fire bowl as claimed in claim 5, characterized in that the rotary body is supported on a vertically movable needle by means of its point.

7. Fire bowl as claimed in claim 6, characterized in that the lower end of the needle rests on a cam disk having a spiral-like cam surface and rotatable around a horizontal axis.

8. Fire bowl as claimed in claim 7, characterized in that the cam disk (13) is connected with a shaft adapted to be rotated by hand and which has a friction brake, and which can be extendable.

9. Fire bowl as claimed in claim 1, characterized in that the rotary body has on its outer periphery a vertically extending flange.

10. Fire bowl as claimed in claim 5, characterized in that the adjustment means includes an elastical intermediate layer between the support means and the rotary body, and that the container is supported by set screws on a table top.

11. Fire bowl as claimed in claim 1, characterized in that the rotary body includes an electric motor having a drive shaft operably connected to the rotary body, the rotary body also including at least one solar cell directed against the wicks and adapted to electrically power the motor, said motor having on its driving shaft a worm which meshes with a worm gear which is operably connected by a slipping clutch to the rotary body.

12. Fire bowl as claimed in claim 1, characterized in that radially adjustable counter balance weights are arranged on the rotary body.

13. Fire bowl as claimed in claim 1, characterized in that the rotary body is provided with a top of sheet-metal deflectors for deflecting warm air.

14. Fire bowl as claimed in claim 1, characterized in that the rotary body includes on its outer periphery a flange extending downwards and immersing into said fuel, said flange having at its bottom edge small recesses through which fuel can flow.

15. Fire bowl as claimed in claim 1, characterized in that the wicks contain heat conductive inserts.

16. Fire bowl as claimed in claim 1, characterized in that each wick comprises an outer shell formed by a wire helix and a core comprising a plurality of glass-sticks and copper wires wherein between the individual glass-sticks and copper wires free space is provided so that fuel like oil, or paraffin can migrate upwards.

17. Fire bowl as claimed in claim 1, characterized in that the rotary body comprises apertures with deflector sheets for the flow of aspirated fresh air, and that on the container a shell with a narrow upper neck is placed.

18. Fire bowl as claimed in claim 17, characterized in that the apertures of the rotary body are arranged on a concentric circle, and that the container comprises apertures with deflectors arranged below said first mentioned apertures, wherein the last mentioned deflectors are inclined opposite to the first mentioned deflectors.

19. Fire bowl as claimed in claim 1, characterized in that the rotary body is supported on a vertical axis, which contains on its upper end a spherical indentation, in which a ball is placed as pivot bearing which ball is connected with the hub of the rotary body.

20. Fire bowl as claimed in claim 1, characterized in that each wick (34) comprises an outer shell formed by a wire helix (59) and a core comprising a glass-stick wherein between the shell and the core free space is provided so that fuel like oil, or paraffin can migrate upwards.

21. Fire bowl as claimed in claim 2, characterized in that the wicks are arranged in individual profiled rings made of a heat-conductive metallic like material, which are perforated and are adapted in thickness to receive the wicks.

22. Fire bowl as claimed in claim 5, characterized in that the rotary body is supported on a vertically movable shank having a ball adjacent the end thereof.

23. Fire bowl as claimed in claim 22, characterized in that the lower end of the shank rests on a threaded spindle which is adjustable by means of a flexible shaft.

24. Fire bowl as claimed in claim 23, characterized in that the flexible shaft is connected with a second shaft adapted to be rotated by hand.

* * * * *